US005660535A

United States Patent [19]

Kobus et al.

[11] Patent Number: 5,660,535

[45] Date of Patent: Aug. 26, 1997

[54] METHOD OF OPERATING A CLAW-TYPE VACUUM PUMP AND A CLAW-TYPE VACUUM PUMP SUITABLE FOR CARRYING OUT THE METHOD

[75] Inventors: Andreas Kobus, Schwelm; Uwe Gottschlich, Bornheim; Lothar Brenner, Bad Munstereifel; Hartmut Kriehn, Cologne, all of Germany

[73] Assignee: Leybold Aktiengesellschaft, Hanau, Germany

[21] Appl. No.: 696,023

[22] Filed: Aug. 9, 1996

Related U.S. Application Data

[63] Continuation of Ser. No. 411,746, filed as PCT/EP93/02349, Aug. 31, 1993, published as WO94/08141, Apr. 14, 1994, abandoned.

[30] Foreign Application Priority Data

Oct. 2, 1992 [DE] Germany ..... 42 33 142.0

[51] Int. Cl.[6] ..... F04C 18/18; F04C 25/02; F04C 29/04

[52] U.S. Cl. ..... 418/1; 418/9; 418/15; 418/83

[58] Field of Search ..... 418/1, 9, 15, 83, 418/186

[56] References Cited

U.S. PATENT DOCUMENTS

| | | | |
|---|---|---|---|
| 1,531,607 | 3/1925 | Green | 418/83 |
| 4,137,022 | 1/1979 | Lassota | 418/83 |
| 4,504,201 | 3/1985 | Wycliffe | 418/9 |
| 4,983,107 | 1/1991 | Steffens et al. | 418/9 |
| 5,173,041 | 12/1992 | Niimura et al. | 418/9 |

FOREIGN PATENT DOCUMENTS

| | | |
|---|---|---|
| 0290663 | 5/1987 | European Pat. Off. . |
| 0272767 | 6/1988 | European Pat. Off. . |
| 0365695 | 5/1990 | European Pat. Off. . |
| 2642479 | 3/1990 | France . |
| 9214060 | 8/1992 | WIPO . |

*Primary Examiner*—John J. Vrablik
*Attorney, Agent, or Firm*—Harris Beach & Wilcox LLP

[57] ABSTRACT

A method of operating a claw-type vacuum pump with two or more stages, each of which has a suction chamber with a pair of claw rotors and end-located suction and discharge ports. To avoid the possibility of liquids affecting operation of the pump, the invention proposes that the pump is operated without internal compression and that the gases emerging from at least one stage are cooled.

14 Claims, 2 Drawing Sheets

METHOD OF OPERATING A CLAW-TYPE VACUUM PUMP AND A CLAW-TYPE VACUUM PUMP SUITABLE FOR CARRYING OUT THE METHOD

This application is a continuation of application, Ser. No. 08/411,746, filed as PCT/EP93/02349, Aug. 31, 1993, published as WO94/08141, Apr. 14, 1994, abandoned.

BACKGROUND OF THE INVENTION

1. Field of the Invention

The invention relates to a method of operation for a claw-type vacuum pump with two or more stages, each of which has a suction chamber with a pair of claw rotors and end-located suction and discharge ports. Moreover, the invention relates to a claw-type vacuum pump suitable for carrying out this method of operation.

2. Discussion of the Related Art

A claw-type vacuum pump is known from EU-A 365 695. Each rotor of the rotor pairs is equipped with a claw (tooth) and a recess respectively. They rotate comb-like in the suction chamber without coming in to contact. During the synchronous motion the rotors at first create spaces which increase in volume, after which the volume of these spaces is reduced, whereby these spaces displace the gas flowing in at the suction side to the pressure side. It is the task of the claws to separate the suction side from the pressure side. For this, the peripheral surface areas of the claws form the necessary sealing gaps together with the peripheral inside wall of the suction chamber. During the combing pass of the recessed areas of the claws through the central area of the suction chamber (pass-through phase), the claws are not able to fulfill their task of separating the suction side from the pressure side, because during this phase they are no longer moving close to the peripheral inside wall of the suction chamber. During this phase it is therefore required to ensure that suction side and pressure side are separated by closing the suction port or the discharge port—or both. This is done by the rotors themselves in a known manner. The suction and discharge ports are arranged and designed at the end-location in such a way that they can be opened or closed with the aid of the recesses in the rotors.

OBJECTS AND SUMMARY OF THE INVENTION

It is the task of the present invention to operate and design a claw-type vacuum pump in such a way that its operation is not affected by liquids entering the pump, be this due to condensation or due to a malfunction in the system which is to be evacuated.

According to the invention this task is solved by operating the pump without internal compression and by cooling the emerging gas from at least one—preferably all—stage(s). "Without internal compression" means that displacement volumes which reduce in volume and which are not connected to the corresponding discharge ports must not be allowed to exist. For the design and arrangement of the corresponding discharge port this means, that it will open immediately after completion of the pass-through phase and must remain in its opened position till the beginning of the next pass-through phase. Operation of a claw-type vacuum pump operated and designed in this manner is not affected even when the suction chambers completely fill with liquid. Sealed displacement volumes which reduce in volume and which would lead to a blockage of the pump because of the incompressibility of liquids, do not arise.

In a claw-type vacuum pump operated without internal compression the work done on compression is greater compared to a pump operated with internal compression. Thermal problems due to this are avoided by a cooling system which is provided. Preferably the gases are cooled by a cooling system which follows at the corresponding discharge port. In claw-type vacuum pumps designed in this manner, the gas which is ejected from a stage is cooled in the cooling system which follows at the discharge port. Since during operation of the pump—except during the run-up phase—the intake pressure of a stage is lower than the ejection pressure, a part of the cooled gases will flow back into the suction chamber immediately after opening of the discharge port, so reducing the temperature of the gases delivered during the next ejection phase.

A particularly suitable further development of this invention is to design the disc separating the two suction chambers of consecutive stages as a cooler. In this solution the cooler for the discharge port in the first stage of the two stages, follows directly, so that the backstreaming gas components are effectively cooled in each case.

BRIEF DESCRIPTION OF THE DRAWING

Further advantages and details of the present invention will become apparent from the examples in drawing FIGS. 1 to 3. Wherein drawing

DETAILED DESCRIPTION OF THE INVENTION

Figure 1:
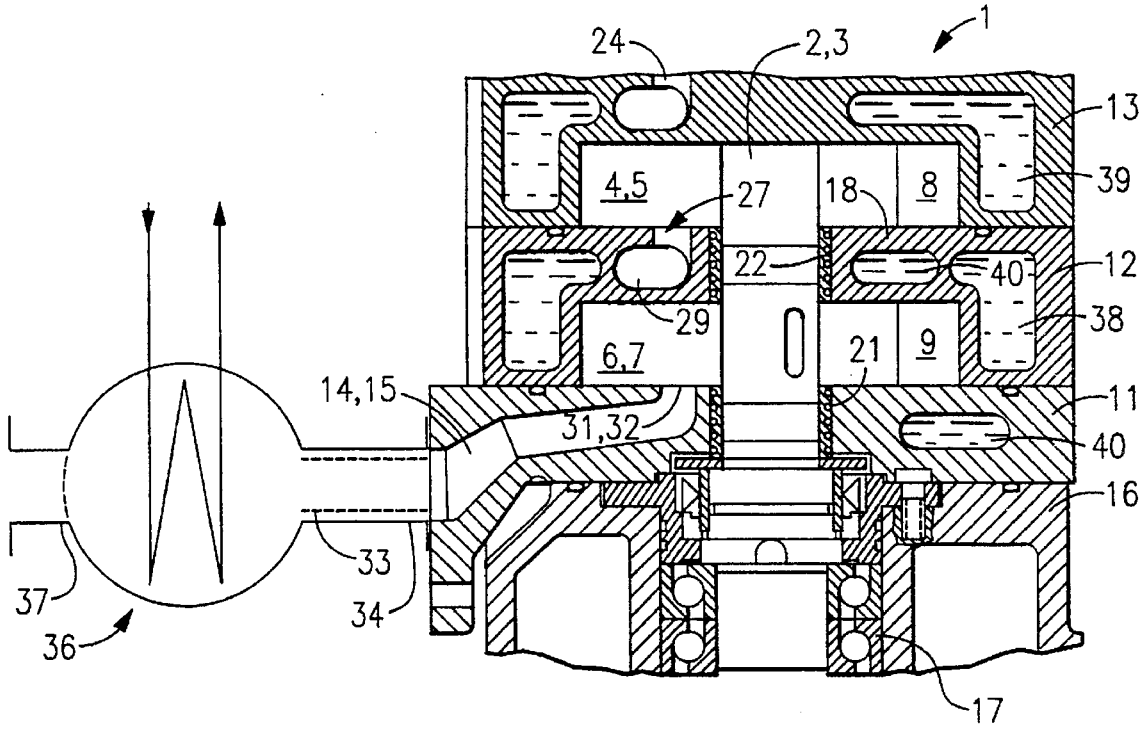
FIG. 1 is a section through a two-stage claw-type vacuum pump at the level of one of the two shafts, drawing
Figure 2:
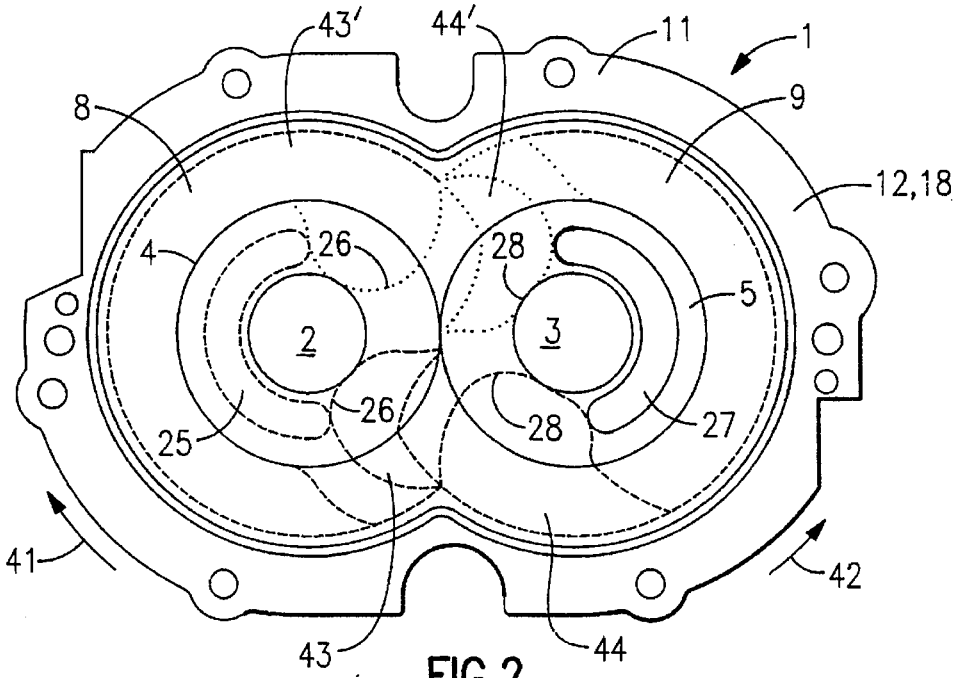
FIG. 2 is a top view on to a pair of rotors in the stage on the suction side or—in the case of more than two stages—in an intermediate stage and drawing
Figure 3:
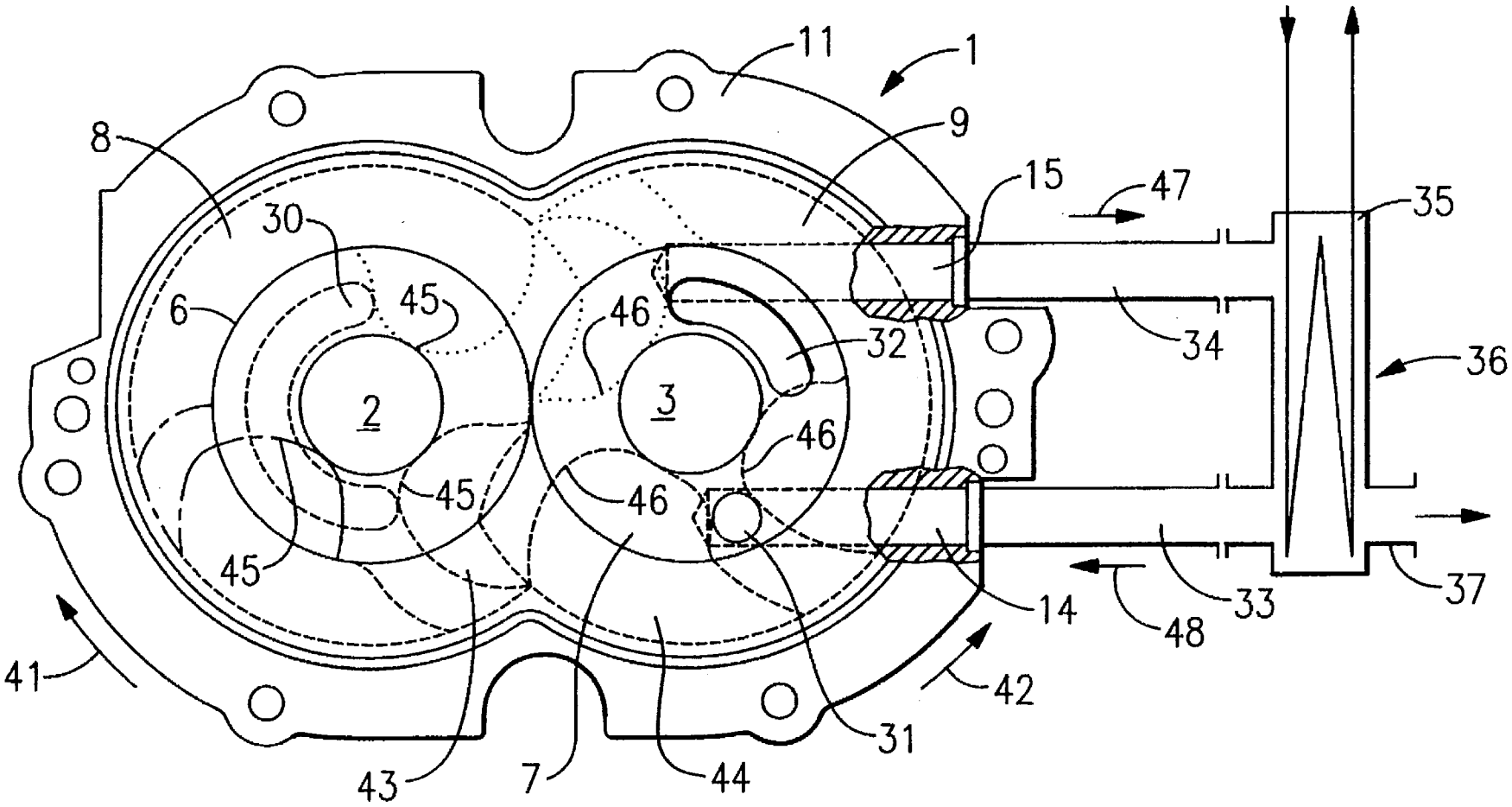
FIG. 3 is a top view on to a pair of rotors in the stage on the pressure side.

In the design examples of FIGS. 1 to 3, parts of a claw-type vacuum pump 1 with two shafts 2, 3 to which rotor pairs 4, 5 and 6, 7 respectively are attached, are shown in each case. Rotor pairs 4, 5 and 6, 7 are of the claw-type. They rotate in suction chambers 8, 9 which are formed by several housing sections 11, 12, 13. Drawing FIG. 1 shows that housing section 11 is a disc into which exhaust gas channels 14, 15 are recessed. Disc 11 is supposed by a housing section 16 in which shafts 2, 3 run in cantilevered bearings 17 and which houses the drive motor which is not shown. The suction chamber 8, 9 are formed by housing sections 12, 13 which resemble the shape of a pot and which are placed on to disc 11. At the same time housing section 12 forms the separating disc 18 between the two suction chambers 8, 9. The shafts 2, 3 penetrate the discs 11 and 18. At the level of these discs they are equipped with bushings 21, 22, the outside of which together with the discs 11, 18 form labyrinth seals. The individual sections of the housing are held together by bolts in a way not shown in detail.

The suction channel 24 penetrates housing section 13 and leads to the end-located suction port 25 (drawing FIG. 2). The slit-shaped suction port 25 which extends along the arc of a circle lies concentrically with respect to shaft 2 and is controlled by recess 26 in rotor 4. The slit-shaped discharge port 27 which also extends along the are of a circle concentrically with respect to shaft 3 is located in disc 18. Its open or closed state is controlled by recess 28 in rotor 5. A channel 29 which penetrates disc 18, follows at the discharge port 27, whereby this channel leads to the suction port 30 (drawing FIG. 3) of the second stage. In disc 11 there are two discharge ports 31 and 32 which are followed by exhaust channels 14, 15 respectively.

Outside of pump 1, exhaust gas lines 33, 34 are directly connected to exhaust gas channels 14, 15, whereby the exhaust lines lead to the housing 35 of a cooler 36. Gases which are sucked in from a vacuum chamber not shown, and which is connected to suction channel 24, are pumped through pump 1 and leave cooler 36 through discharge port 37. Cooling channels 38, 39 through which a coolant flows during operation, are located in the jacket areas of housing sections 12, 13. Further cooling channels 40 can be provided in discs 11, 18 when these at the same time function like a cooler.

In order to be able to operate a claw-type vacuum pump without internal compression as shown in the example, a special design and layout is required for discharge ports 27 and 31, 32 respectively.

For the purpose of explaining this arrangement in the first stage (suction stage, drawing FIG. 2) the pair of claw rotors 4, 5 is shown in two different positions. In the position indicated by long broken lines the claws and the recesses of rotors 4, 5 have just completed their pass-through phase. The continuation of the rotating motion (see arrows 41, 42) causes an increase in the volume of the (small) space 43 between the claws and a reduction in volume of the (large) space 44 also located between the claws. The small space 43 which increases in volume is the suction space and after continuation of the rotating motion it will shortly be linked to suction port 25. The large ejection space 44 which reduces in volume, is linked to the discharge port 27 immediately after the pass-through phase, so that no internal compression will occur.

In the position indicated by the short broken lines in drawing FIG. 2, the claws and recesses are just at the beginning of their pass-through phase. Suction space 43' has attained its greatest volume. Recess 26 has just sealed suction port 25. The ejection space 44' has attained its minimum volume. During the preceding volume reduction step for ejection space 44', the discharge port 27 was open all the time. The pumped gases have not been compressed. In the position of the rotors indicated by the short broken lines, recess 28 has just closed discharge port 27.

A top view on to a pressure stage is shown in drawing FIG. 3. The rotors 6, 7 with their recesses 45, 46 are again shown in different positions whereby the positions indicated by the short and long broken lines correspond to those of the example shown in drawing FIG. 2. A further position is indicated by a dash-dot pattern for the purpose of explaining the difference with respect to the design according to drawing FIG. 2. The second stage (pressure stage according to drawing FIG. 3) differs from the suction stage (or intermediate stage for a pump having more than two stage) shown in drawing FIG. 2, by the fact that two discharge ports (31, 32) are provided. In order to still meet the goal of "no internal compression" the distance between the two discharge ports must be no greater than the width of recess 46, all referring to the arc of the circle on which the discharge ports 31, 32 are placed. Thus the ejection space 44 which reduces in volume, is always linked to one of the discharge ports 31, 32.

Due to the fact that two discharge ports 31, 32 are present, a part of the gas (arrow 47) which is ejected through discharge port 32 and which enters the cooler 36 through the channels 15, 34 which follow, flows back via channels 33, 14 (arrow 48) through discharge port 31 into the suction chamber 9 when the discharge port 31 opens again during the next turn of rotor 7. Since lines 33, 34 are connected to the housing of cooler 36 in such a way that the component which is flowing back also has flowed through the cooler itself, it is possible to maintain a cooling air circuit which is capable of leading the heat away which results from the increased work done on compression.

Also in the suction or intermediate stage with rotors 4, 5 which are operated without internal compression (drawing FIG. 2), the effect of gases flowing into the suction chamber 8 immediately after opening of discharge port 27 occurs, as long as the suction pressure is sufficiently low. This will not be the case only in the presence of high suction pressures during start-up. The heat which is produced, can be lead away by cooling the intermediate disc 18 (cooling channel 40) with gas supply channel 29. When dividing the discharge port 27 according to drawing FIG. 3 (discharge ports 31, 32) the cooling effect will then even be improved. Preferably exhaust gas channel 29 has a widened cross-section so that the dwell time for the gas and thus the cooling effect is also increased. Condensate produced by the cooling, especially in channel 29 passes via suction port 30 into the subsequent stage and is pumped out by this stage.

While this invention has been described in detail with reference to certain preferred embodiments, it should be appreciated that the present invention is not limited to those precise embodiments. Rather, in view of the present disclosure which describes the best mode for practicing the invention, many modifications and variations would present themselves to those of skill in the art without departing from the scope and spirit of this invention, as defined in the following claims.

What is claimed is:

1. Method of operating a claw-type vacuum pump (1) With two or more stages, each of which has a suction chamber (8, 9) with a pair of claw rotors (4, 5; 6, 7) and end-located suction and discharge ports (25, 27; 30, 31, 32), wherein the pump (1) is operated without internal compression and the gases emerging from at least one stage are cooled.

2. A claw-type vacuum pump having a succession of pass-through phases, said claw-type vacuum pump having two or more stages in a housing, at least one of said stages having a means for cooling gases, each of said stages having a suction chamber (8,9) with a pair of claw rotors (4,5;6,7), end-located suction ports (25,30) and discharge ports (27;31, 32), end faces and recesses of said claw rotors opening and closing said suction and discharge ports, wherein each of said discharge ports is opened by said claw rotors immediately after the end of each pass-through phase and is closed at the beginning of each pass-through phase.

3. The claw-type vacuum pump according to claim 2, wherein said cooling means includes a cooling system (18,36) connected to each of said discharge ports.

4. The claw-type vacuum pump according to claim 3, further comprising a disc (18) which separates said suction chambers of two consecutive stages, and a disc (11) designed as a cooler which is penetrated by the discharge port on the pressure side.

5. The claw-type vacuum pump according to claim 4, further comprising a gas supply channel (29) which penetrates said disc (18) and links the two stages, said gas supply channel having a widened cross section for the purpose of increasing the dwell time of the gases.

6. The claw-type vacuum pump according to claim 3, wherein said cooling system includes a cooler (36) which is arranged externally.

7. The claw-type vacuum pump according to claim 2, further comprising an exhaust gas line (14,15;29;33,34,37) which directly follows at each discharge port (27;31,32) of a preselected stage so that it is linked to said means for cooling.

8. The claw-type vacuum pump according to claim 2, wherein one of said stages is a pressure stage, said pressure stage having two discharge ports (31,32), being opened and closed by one of said claw-type rotors, said one claw rotor opening and closing said discharge ports, said one claw rotor further including a recess (46), the distance between said discharge ports being less than the width of said recess.

9. The claw-type vacuum pump according to claim 7, wherein said means for cooling further includes said housing (35), and a separate exhaust gas line (33,34) follows at each of two discharge ports (31,32), both of said exhaust gas lines leading into said housing.

10. The claw-type vacuum pump according to claim 9, wherein the two exhaust gas lines (33,34) are connected to said housing (35) of the means for cooling such that a gas flowing through one (34) of the two exhaust gas lines into said means for cooling and gas flowing back into said suction chamber through the second exhaust gas line (33), flows through said means for cooling.

11. The claw-type vacuum pump according to claim 2, further comprising a suction stage, a pressure stage and a disc (18) separating the two stages, said disc acting as a cooler for the gases ejected from said suction stage, said pressure stage having a cooler assigned to the gases ejecting from said pressure stage.

12. The claw-type vacuum pump according to claim 2, further comprising shafts (2,7), wherein said shafts and said claw rotors (4,5;6,7) form rotating systems within said housing (16) and which run in cantilevered bearings.

13. The claw-type vacuum pump according to claim 2, wherein said suction chambers further include housing sections (12,13) which resemble the shape of a pot.

14. The claw-type vacuum pump according to claim 11, further comprising exhaust gas lines and disc (11) designed as a cooler, wherein said discs further include a jacket having cooling channels (38,39) and additional cooling channels (40), said discs accepting said exhaust gas lines.

* * * * *